US005288163A

United States Patent [19]

Munson

[11] Patent Number: 5,288,163

[45] Date of Patent: Feb. 22, 1994

[54] AIRPORT PAVEMENT MARKING SYSTEM FOR SURFACE MOVEMENT GUIDANCE

[76] Inventor: William D. Munson, 24480 Airport Rd., Philomath, Oreg. 97370

[21] Appl. No.: 717,911

[22] Filed: Jun. 20, 1991

[51] Int. Cl.[5] ..... E01F 9/00; G09F 21/06

[52] U.S. Cl. ..... 404/9; 40/217; 33/574

[58] Field of Search ..... 404/9-11, 404/12-16; 116/209; 40/565, 299, 217; 33/332, 574

[56] References Cited

U.S. PATENT DOCUMENTS 3,936,207 2/1976 Sticha ..... 404/1 X
4,620,816 11/1986 Kupfer ..... 404/9 X

OTHER PUBLICATIONS

"F.A.A. Seeks to Halt Rise in Near Collisions of Jets," *The New York Times*, B24, Col. 3 (Oct. 16, 1991).
"Is Flying Safe?" *The Washington Times*, A17 (Mar. 8, 1992).
"Bureaucracy is Killing Us," *The Cleveland Plain Dealer*, A1 (Feb. 28, 1993).
"Close Calls Are on the Rise At Airports," *The New York Times*, A18, Col. 5 (Dec. 18, 1990).
"Concern for Runway Safety," *Newsday*, p. 3 (Feb. 2, 1991).
"Airport Runway Dangers Abound," *The San Francisco Chronicle*, A7 (Feb. 2, 1991).
"Controller Tells of Fright After Runway Near Crash," *The New York Star-Ledger*, p. 40 (Mar. 18, 1993).
Gellings, "Airports," *Air Line Pilot*, p. 3, (Feb. 1991).
U.S. DOT/FAA, "Sea-Tac Airport Runway Incursion Plan," Appendix F (May 1991).

*Primary Examiner*—James R. Brittain
*Assistant Examiner*—Nancy P. Connolly
*Attorney, Agent, or Firm*—Lerner, David, Littenberg, Krumholz & Mentlik

[57] ABSTRACT

A surface movement guidance system for airport traffic of a continuous elongated row of one or more indicia extending lengthwise along a route on the airport surface to be traversed by the traffic, which indicia convey information about position on the airport surface.

14 Claims, 7 Drawing Sheets

AIRPORT PAVEMENT MARKING SYSTEM FOR SURFACE MOVEMENT GUIDANCE

BACKGROUND OF THE INVENTION

The present invention relates to surface movement guidance systems for traffic on airfield pathways adapted to convey to the vehicle operators information regarding the position of a vehicle, particularly when visibility is poor.

Ground safety remains a problem at busy airports across the United States. The movement of aircraft in and around busy airports along taxiways between terminal gates and runways presents numerous opportunities for runway incursions, particularly when visibility is poor. A runway incursion is the entry of an aircraft without clearance onto an active runway from an adjacent ramp or taxiway, for which there is a great deal of risk of collision with a landing or departing aircraft. Incursions are often the inadvertent result of pilot disorientation caused by poor visibility.

As recently as Dec. 3, 1990, in an accident attributed to fog-reduced visibility, a Northwest Airlines jet at Detroit Metropolitan Airport took two wrong turns and taxied in front of another Northwest Airlines jet that was taking off, resulting in a collision that killed eight people. A runway incursion by a fog-disoriented pilot who mistook an active runway for a taxiway resulted in the worst disaster in aviation history when the ground collision of two Boeing 747 jetliners at Tenerife Airport in the Canary Islands in March 1977 resulted in the deaths of 583 people.

In 1990 in the United States alone, over 250 runway incursion incidents were reported. This does not include incidents such as taxiway collisions or near-misses resulting from vehicle operators mistaking one taxiway for another. Runway incursions and other taxiway incidents can still represent inconvenience and expense even when a ground collision does not result. To return an aircraft to a path from which it has strayed requires a considerable expenditure of time and fuel, and a compromise to the safety of all involved.

Guidance systems are known that assist taxiing aircraft in finding the centerline of taxiways and runways during poor visibility conditions, such as disclosed by U.S. Pat. No. 3,662,977 to Shannon. Airport pathways such as runways and taxiways are routinely marked at either or both ends by signs adjacent to the pavement or pavement markings. However, these signs and pavement markings are not visible from most locations on the runway or taxiway during conditions of poor visibility.

Lighted runway guidance systems are also known that illuminate the paths to be followed by an aircraft on a taxiway or runway when taking off and landing at night and when visibility is poor. Airport Surface Detection Systems are currently under procurement for major U.S. airports that utilize advanced ground-mapping radar to control aircraft and ground vehicles during inclement weather. However, such systems will not be procured for every airport, and, regardless, there remains a need for a simple, easily-installed system that identifies the path and the location and identity of intersecting pathways for pilots, especially during periods of poor visibility.

SUMMARY OF THE INVENTION

This need is met by the present invention, the implementation of which can substantially reduce the incidence of runway incursions by disoriented pilots. The above disasters could have been prevented by the system of the present invention, which, once implemented, can virtually eliminate ground collisions between aircraft attributable to pilot disorientation, particularly during poor visibility. The present invention can thus significantly improve ground safety at busy airports.

One aspect of the present invention provides a surface movement guidance system for airport traffic in which a continuous elongated row of indicia extends along a centerline of a route on the airport surface to be traversed by the traffic, which indicia convey information about position on the airport surface. In one embodiment of the present invention, the continuous elongated row of indicia extends substantially along a centerline of a first preselected pathway on the airport surface and the indicia in the row include first indicia denoting the identity of the first preselected pathway, whereby the first indicia indicate position on the first preselected pathway. In a second embodiment of the present invention, the continuous elongated row of indicia extends substantially between the centerline of a first preselected pathway and the centerline of a second preselected pathway at an intersection of the first and second pathways so that the elongated row of indicia is positioned on the route to be traversed by a vehicle travelling between the first pathway and the second pathway, which indicia in the row include second indicia denoting the identity of the second pathway. In a third embodiment of the present invention, both the first and second embodiments of the invention are combined to indicate to airport vehicle operators both position on the first pathway and the identity of a second pathway intersecting the first pathway.

Included within another aspect of the present invention is a method for providing information about position on airport surfaces to airport vehicle operators in need thereof by marking a continuous elongated row of indicia lengthwise along a route to be traversed by airport traffic, said indicia conveying information about position on the airport surface.

According to preferred embodiments of the foregoing aspects of the present invention, the indicia are codified for identification of airport taxiways and runways, and taxiway-runway intersections and are used to mark the route for airport traffic to follow between taxiways and active runways. The indicia can also be used to mark the routes between aprons, ramps, terminal gates and aircraft parking areas and can be codified to identify same.

The present invention is particularly advantageous because it can be rapidly implemented in the form of permanent indicia. The indicia bear information that is always in view of a taxiing pilot, which information provides positive ground path identification and location.

Other objects, features and advantages of the present invention will be more readily apparent from the detailed description of the preferred embodiments set forth below, taken in conjunction with the accompanying drawings.

DETAILED DESCRIPTION OF THE PREFERRED EMBODIMENT

Figure 1:
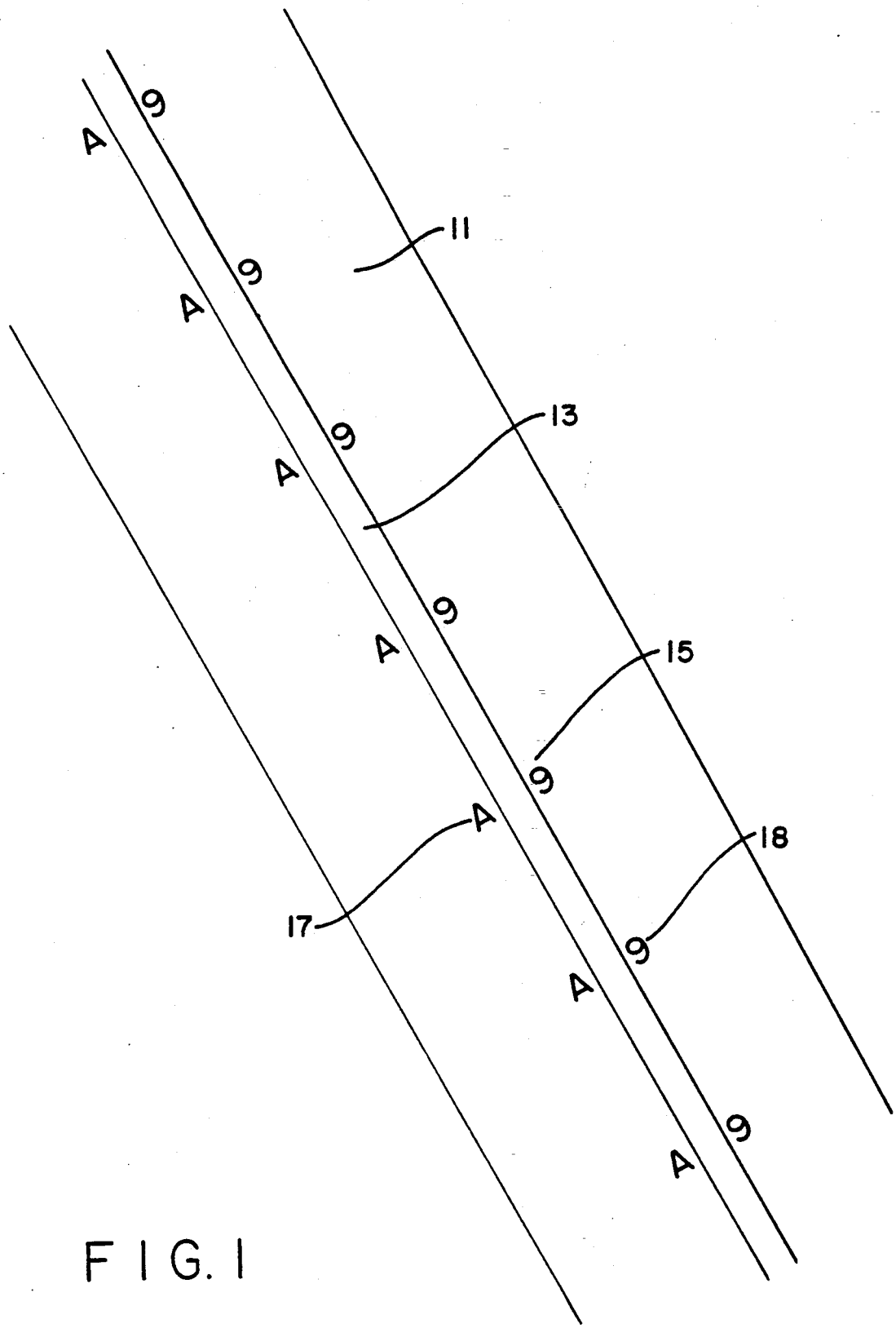
FIG. 1 depicts a runway marked with a surface movement guidance system according to one embodiment of the present invention.

The surface movement guidance system of the present invention marks airport surfaces to be traversed by airport traffic with a continuous elongated row of indicia extending lengthwise along routes to be followed by the traffic. For purposes of the present invention, an airport vehicle is defined as an aircraft arriving at or departing from the airport, as well as vehicles for servicing such aircraft. Airport pathways within the scope of the present invention include all airport pavement to be traversed by an inbound or departing aircraft from the terminal to and including the runway. Examples of such pavement include, but are not limited to, aircraft terminal parking areas, taxiways, ramps, aprons, runways and the like.

The surface movement guidance system of the present invention can replace or supplement the centerline marking on an airport pathway. Furthermore, the indicia within each continuous elongated row in accordance with the present invention are light-reflective rather than light-emitting. Therefore, any material suitable for marking pavement can be utilized to apply the continuous elongated row of indicia in accordance with the present invention to an airport pathway, and the installation of the system and method of the present invention can be simplified by utilizing the same pavement marking materials that are used to apply the centerline of the pathway. Furthermore, any of the well-known methods of applying pavement markings to pavement, and more particularly to airport runways and taxiways, are suitable for use with the present invention. Such methods include painting, heat bonding and gluing markings in place.

The indicia should be spaced apart so that no matter where a vehicle is located on an airfield pathway, at least one indicia will be visible to the vehicle operator. The maximum distance between indicia should be that distance within view of the vehicle operator under visibility conditions that are poor but do not require suspension of airport operations. Ideally, indicia within the continuous elongated rows of indicia are spaced together as closely as possible; however, the installation and maintenance of such a system can be costly. Therefore, indicia spaced apart by a distance of between about one and about twenty feet within continuous elongated rows of indicia are among the preferred embodiments of the present invention.

Preferably, the indicia should be sized to allow for maximum readability during poor visibility at the rated speed for the area to which they are applied. In other words, larger indicia are preferred for high speed traffic areas. It will also be appreciated that the spacing between indicia is also a function of indicia size. That is, the larger the indicia, the farther apart they can be spaced and still have at least one indicia within view of a vehicle operator during poor visibility conditions.

For purposes of the present invention, indicia are defined as information-bearing symbols and can be alpha-numeric characters or any other symbols capable of conveying information. The indicia can also be color-coded to convey information.

Alpha-numeric characters are preferred because they can be readily adapted to existing airfield pathway marking conventions. As can be appreciated from the marking systems depicted in the figures, when alpha-numeric characters are used, the information-bearing sequences of one or more indicia within a sequence member will appear upside-down to pilots travelling in one direction and correct to pilots travelling in the opposite direction.

One way to avoid this situation is by writing the indicia sideways, although the indicia will still appear backwards to pilots travelling in one direction. Another way to avoid this situation is by alternating the direction of the indicia so that an upsidedown or backwards indicia will alternate with a "correct" indicia for airport vehicle operators travelling from both directions. Still yet another way this situation can be avoided by the use of symbols rather than alpha-numeric characters, although the fact that alpha-numeric characters are correct in one direction and upside-down or backwards in an opposite direction can be advantageous. An outbound-inbound standard can be established for "correct" versus upside-down or backward characters, thereby enabling pilots to confirm that they are headed in the proper inbound or outbound direction on an airfield pathway. To prevent ambiguities, it would be necessary to distinguish 6's from 9's and m's from w's and to avoid combinations of numbers and letters that read the same from both directions, such as 0's, 1's, 8's i's and o's. One conventional method to prevent ambiguity is to underline the bottom of the indicia character.

As noted above, a continuous elongated row of indicia extending lengthwise along a route on the airport surface to be travelled by airport traffic in accordance with the present invention, may contain first indicia that provide information regarding a first pathway along the route on which the traffic is to travel. As such, the continuous elongated row of first indicia will be located within twenty feet of the centerline of the first pathway; preferably the centerline marking of the first pathway is formed in whole or in part by the continuous elongated row of first indicia. Most preferably, the continuous elongated row of first indicia extends substantially the entire length of the first pathway.

As also noted above, a continuous elongated row of indicia extending lengthwise along a route on the airport surface to be traveled by airport traffic, in accordance with the present invention, may contain second indicia that provide information regarding a second pathway intersecting the first pathway. The elongated row of second indicia extends lengthwise along a predetermined route to be traversed by airport traffic between the centerline of the first pathway and the centerline of the second pathway intersecting the first pathway. As such, the continuous elongated row of second indicia will be located within twenty feet of the route to be traversed between the centerline of the first pathway and the centerline of the second pathways intersecting the first pathway, and preferably, this route is marked in whole or in part by the continuous elongated row of second indicia. Preferably, the elongated row of second indicia will mark the most direct route between the first pathway and the second pathway intersecting the first pathway to be traversed by airport traffic.

The continuous elongated row of second indicia should begin on the first pathway at least 100 feet in advance of the intersection between the first pathway ad the second pathway so as to inform vehicle operators that they are approaching the intersection. More preferably, the continuous elongated row of second indicia should begin on the first pathway at least 500 feet, and even more preferably at least 1,000 feet, in advance of the intersection between the first pathway and the second pathway. The second indicia can be initially spaced farther apart than the first indicia, and then increase in frequency as the intersection approaches to inform vehicle operators as to the proximity of the intersection. Once the row of second indicia meets the second pathway, the frequency can then decrease to denote completion of the turn off.

It will accordingly be appreciated then that from at least about 100 to about 1,000 feet in advance of intersections between first pathways and second pathways continuous elongated rows of first and second indicia will extend lengthwise along the first pathway. The first and second indicia may be spaced closely together so as to appear as a single continuous elongated row of groups of first and second indicia. In the alternative, the first and second indicia may be spaced apart as separate continuous elongated rows of first and second indicia.

In accordance with the present invention, means can be employed to distinguish the first indicia from the second indicia when both first and second indicia are present on a first pathway so that airport vehicle operators can readily determine which indicia is a first indicia identifying the pathway on which the vehicle is located and which indicia is a second indicia identifying an intersecting pathway. One way to accomplish this is by positioning the continuous elongated row of first indicia substantially on the centerline of the first pathway while offsetting from the centerline of the first pathway the position of the continuous elongated row of second indicia. Another way to distinguish between first and second indicia is by utilizing separate character, symbol or color codes for first and second indicia.

Referring to the figures, FIG. 1 depicts a surface movement guidance system according to one embodiment of the present invention. Runway 11 having centerline 13 is marked with a continuous elongated row 15 of alpha-numeric indicia 17 and 18, that extend lengthwise along the runway. The alpha-numeric characters represent first indicia that, in accordance with the present invention, identify the runway. Indicia 17 is applied to the left of the centerline and indicia 18 is applied to the right of the centerline.

Figure 3:
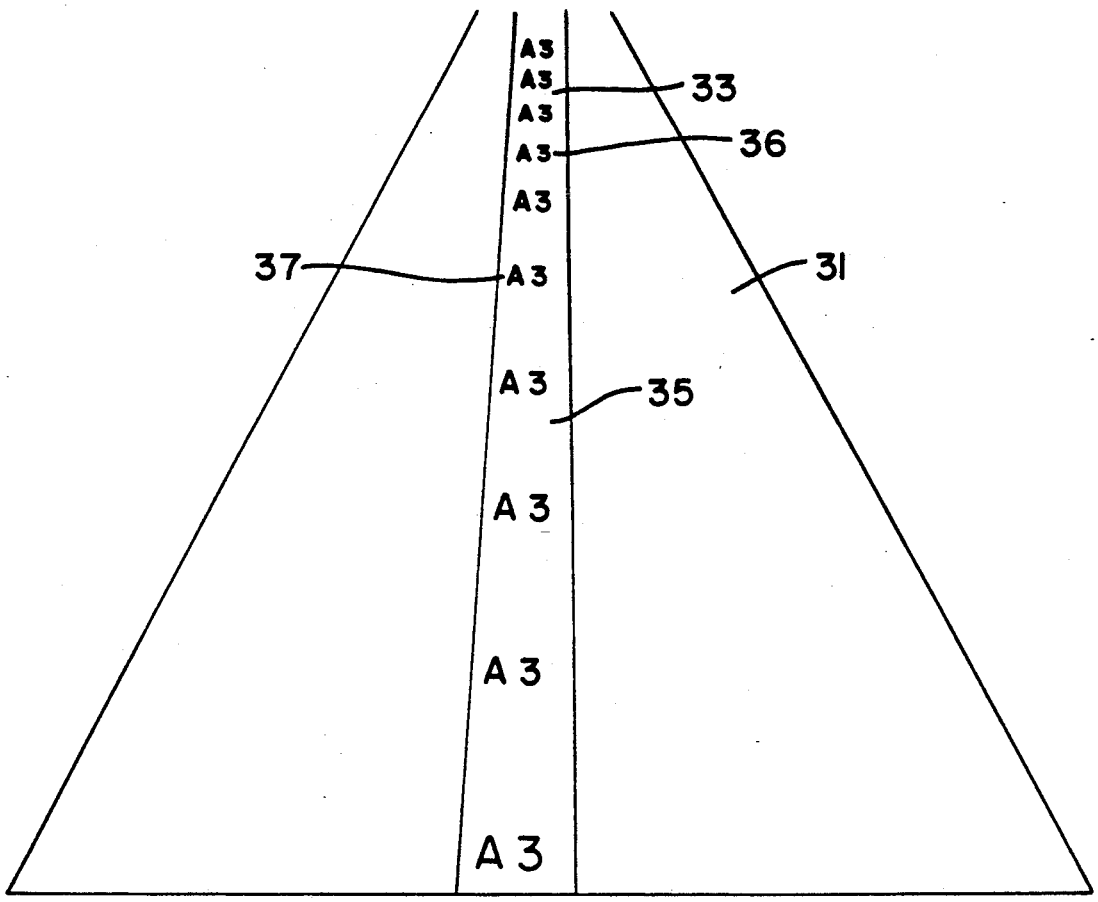
FIG. 3 is an elevated perspective view of a runway marked with a surface movement guidance system according to another embodiment of the present invention.

A variation of the embodiment of FIG. 1 of the system of the present invention is depicted in FIG. 3. A continuous elongated row 33 of indicia 36 and 37 extend lengthwise along runway 31 within centerline 35. The indicia are applied as a contrasting image within the centerline by either applying indicia of a contrasting color directly over the centerline, or by applying the centerline in a color contrasting with the color of the runway pavement and using a stencil or mask when applying the centerline to create a negative image of the indicia having the color of the pavement.

Figure 2:
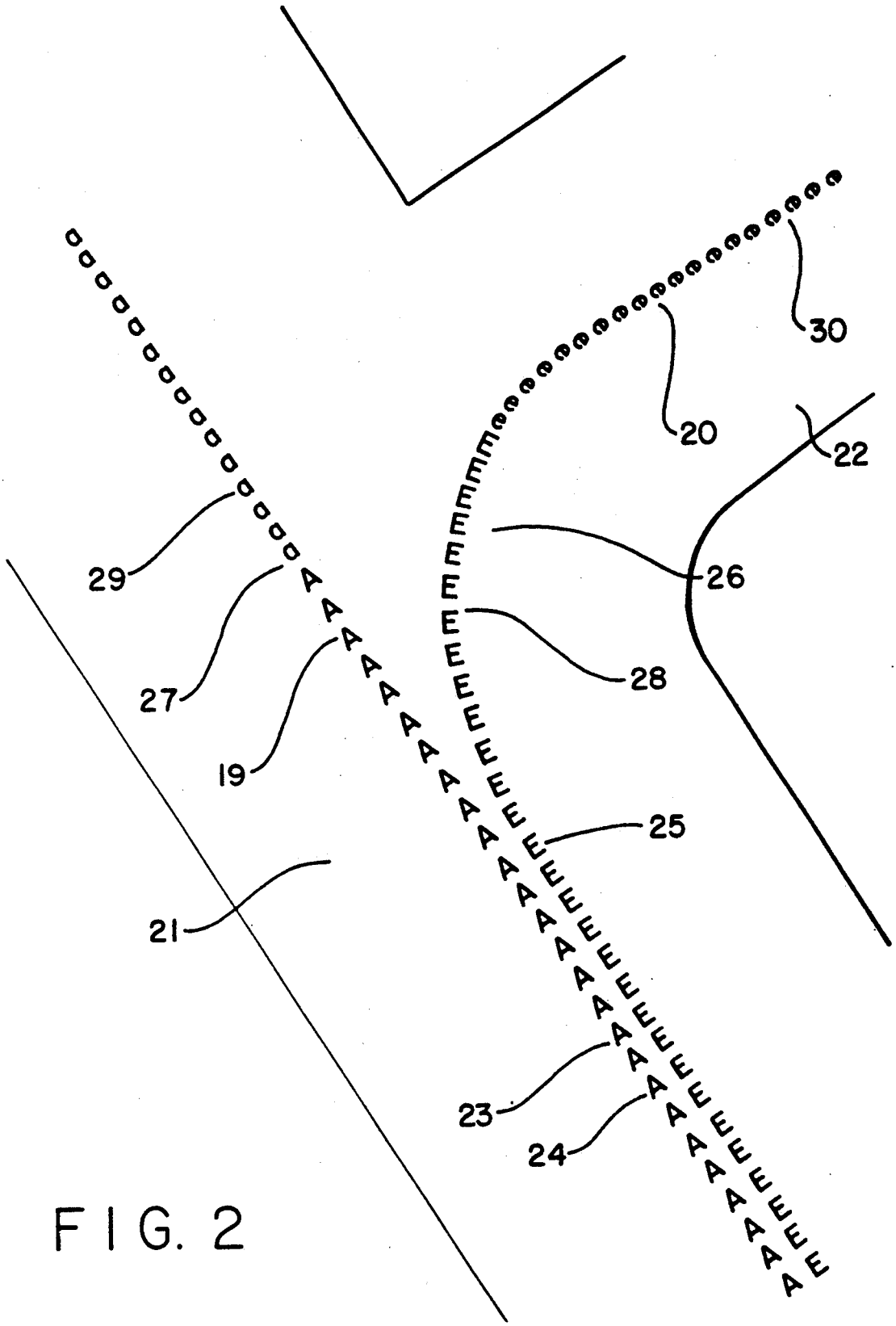
FIG. 2 depicts a runway-taxiway intersection marked with a surface movement guidance system according to another embodiment of the present invention.

FIG. 2 depicts the intersection between an active runway and taxiway, marked with the surface movement guidance system of the present invention. Runway 21 and taxiway 22 are shown. Before the intersection with taxiway 22, the centerline 19 of runway 21 is a single continuous elongated row 23 of alpha-numeric indicia 24 and 25. Indicia 24 represent first indicia in accordance with the present invention and identifies runway 21. Indicia 24 extend lengthwise along runway 21 in a continuous elongated row. Indicia 25 represent second indicia in accordance with the present invention and identify intersecting taxiway 22. A continuous elongated row of indicia 25 extend lengthwise marking a route 28 between the centerline of runway 21 and the centerline of taxiway 22. The route 28 defines the runway turnout for the taxiway 22 and along this route indicia 24 and 25 no longer appear within the same continuous elongated row, but instead the characters diverge as separate continuous elongated rows, 26 and 27 of indicia. In the depicted embodiment, indicia 25 is an upper-case alphabet character that is replaced by lower-case character indicia 29 at the intersection of route 28 with the centerline 20 of taxiway 22. This informs vehicle operators that they have passed from the active runway to the taxiway. Likewise, beyond the centerline 20 of taxiway 22, indicia 24 is an upper-case alphabet character that is replaced by lower-case character 30, which informs vehicle operators they have passed the centerline of the intersecting taxiway.

Figure 4:
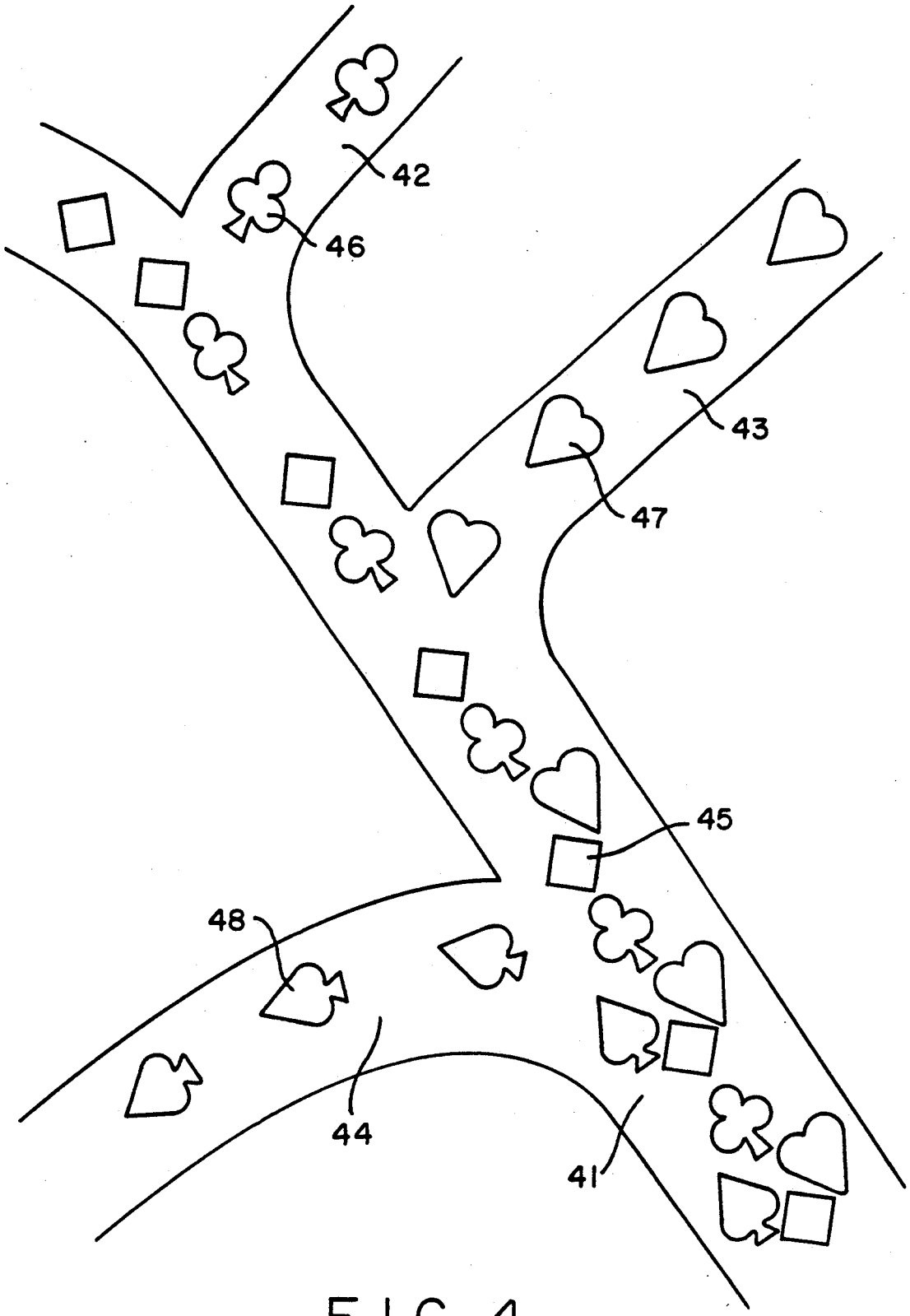
FIG. 4 depicts taxiways marked with a surface movement guidance system according to yet another embodiment of the present invention.

FIG. 4 represents an alternate embodiment of the present invention in which taxiways 42, 43 and 44 off of runway 41 are identified by symbols 46, 47 and 48. Runway 41 is identified by symbol 45. The symbols are familiar shapes and designs that represent alternatives to alpha-numeric characters.

Figure 5:
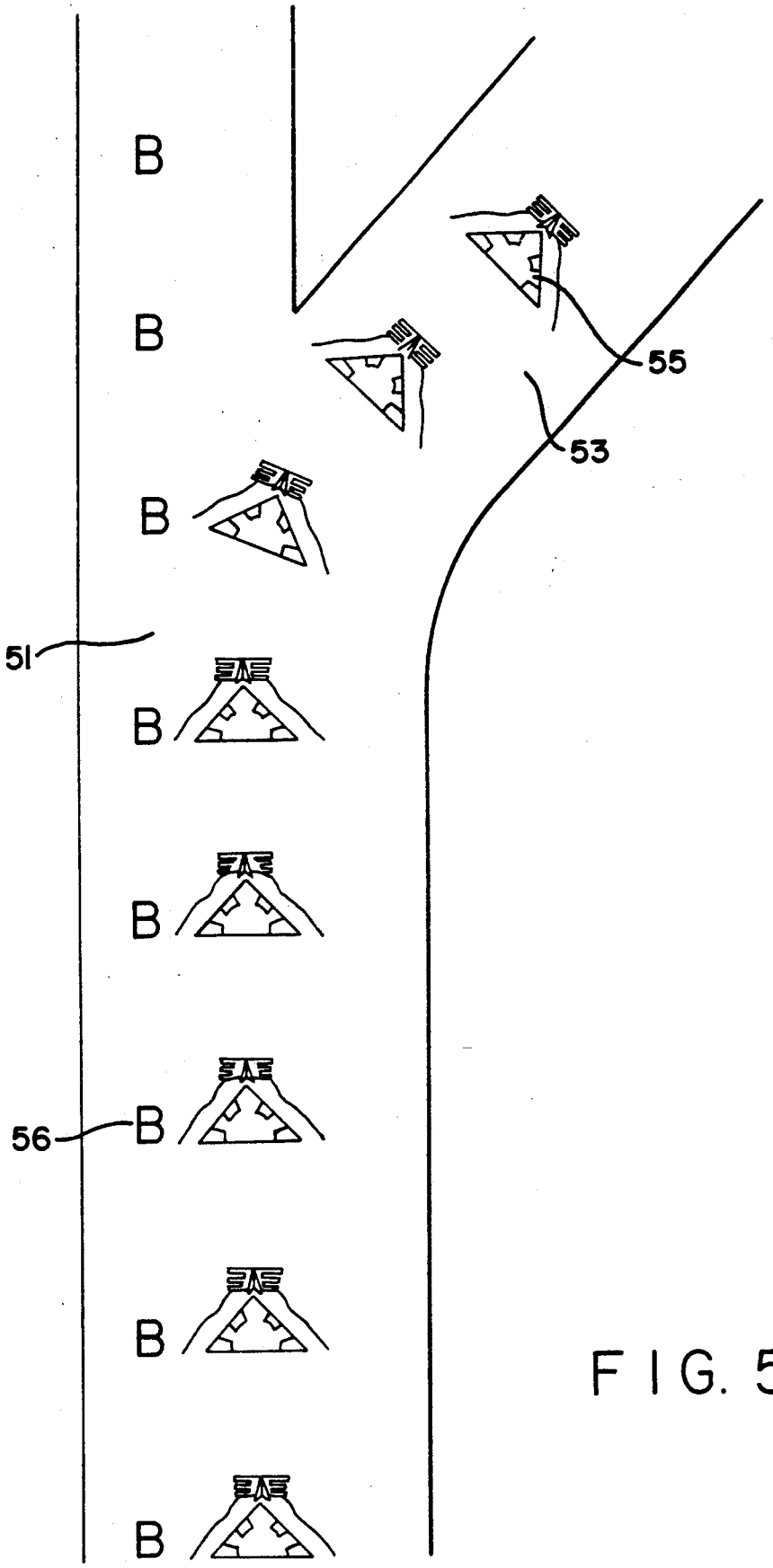
FIG. 5 depicts a taxiway leading to an airline terminal marked with a surface movement guidance system according to still yet another embodiment of the present invention.

FIG. 5 depicts an alternate use of symbols in which an airline logo is used to identify the route to a terminal parking area. In particular, route 53 from taxiway 51 is identified by logo 55. Alpha-numeric indicia 56 identities taxiway 51.

Figure 6:
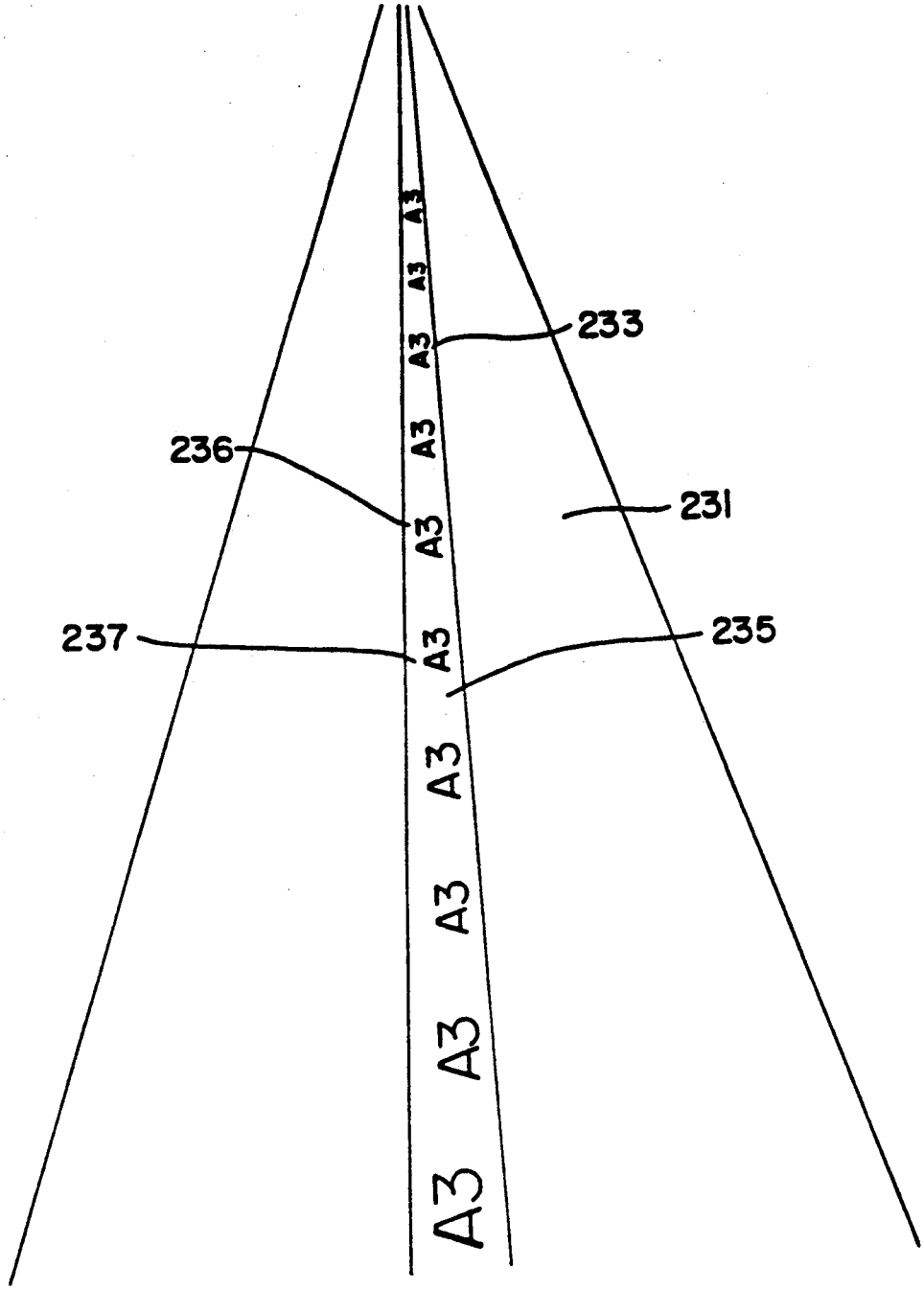
FIG. 6 is an elevated perspective view of a runway marked with a surface movement guidance system according to yet another embodiment of the present invention.

FIG. 6 represents another alternate embodiment of the invention in which indicia 236 and 237 of indicia row 233 are applied sideways to facilitate comprehension of the indicia from both directions. In this embodiment, the indicia are applied within centerline 235 of runway 231.

Figure 7:
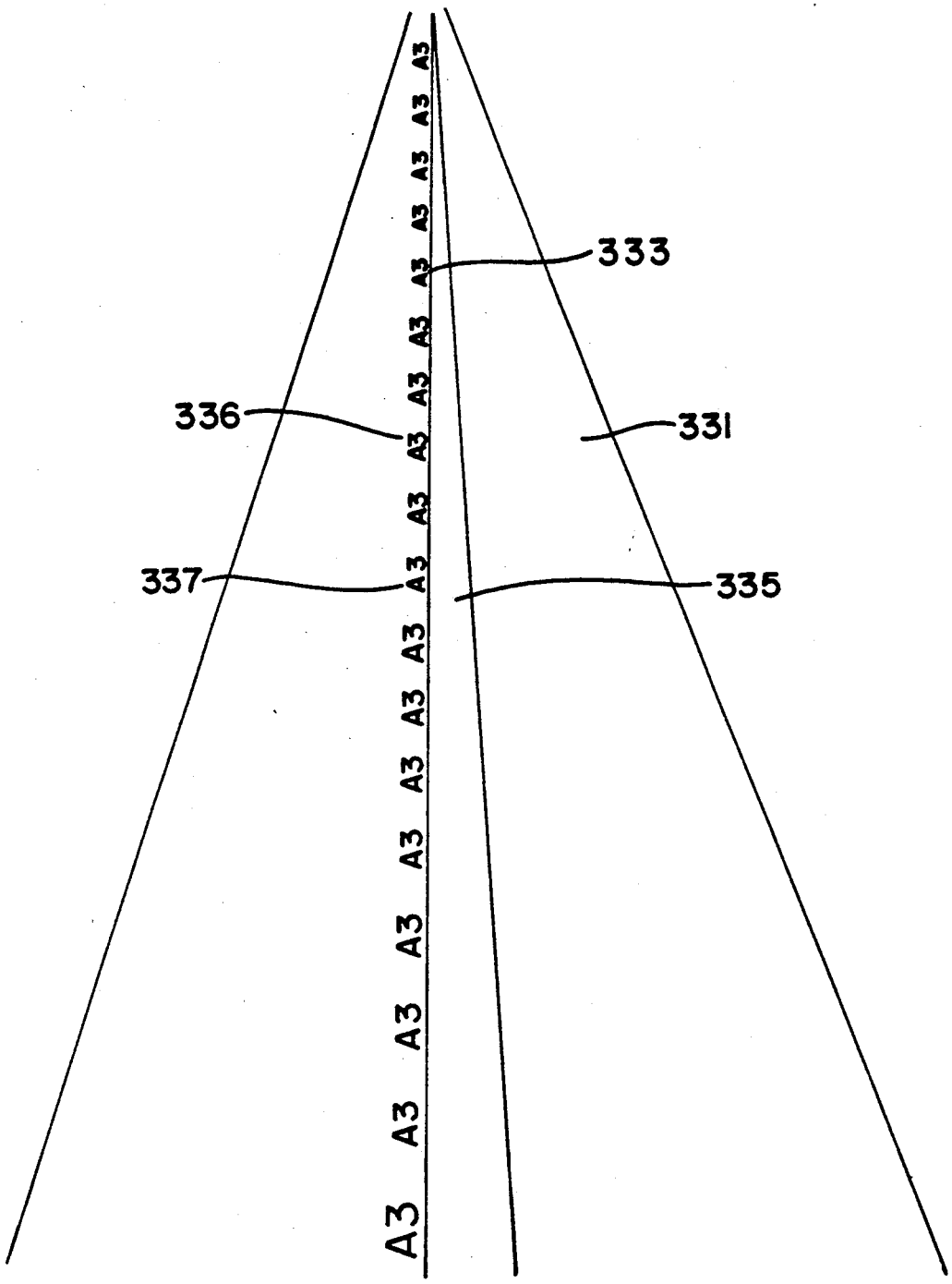
FIG. 7 is an elevated perspective view of a runway marked with a surface movement guidance system according to yet another embodiment of the present invention.

FIG. 7 depicts a variation of the embodiment of FIG. 6 in which continuous elongated row 333 of indicia 336 and 337 are applied sideways to one side of the centerline 335 of runway 331.

The surface movement guidance system of the present invention represents a method by which information may be provided about position on an airport surface to airport vehicle operators in need thereof by marking a continuous elongated row of indicia lengthwise along a route to be traversed by airport traffic, which indicia conveys information about position on the airport surface. It will accordingly be appreciated that the present invention is an inexpensive, easily-installed system and method by which airport pathways are marked so that during poor visibility conditions, aircraft pilots and other vehicle operators will always have directly in front of them information regarding their location. The present invention represents a significant advancement in the prevention of incursions onto active runways by aircraft pilots and other vehicle operators, thereby improving the ground safety at busy airports.

As will be readily appreciated, numerous variations and combinations of the features set forth above can be utilized without departing from the present invention as set forth in the claims. Such variations are not regarded as a departure from the spirit and scope of the invention, and all such modifications are intended to be included within the scope of the following claims.

What I claim is:

1. A method for identifying airport taxiways and taxiway intersections, which method comprises the steps of:

marking a first taxiway with a continuous elongated row of first indicia identifying said first taxiway;

marking said first taxiway with a continuous elongated row of second indicia identifying an intersection with a runway or second taxiway beginning at least 100 feet in advance of said intersection, wherein the spacing between said second indicia decreases with proximity to said intersection;

marking said intersection along the route to be traversed between said first taxiway and said runway of second taxiway with said row of second indicia; and marking said runway or second taxiway with said row of second indicia after said intersection, wherein said spacing between said second indicia increases with proximity to said intersection and said row of second indicia extends substantially along the centerline of said runway or second taxiway.

2. The method of claim 1, wherein said row of first indicia extends substantially along the centerline of said first taxiway.

3. The method of claim 1, wherein said row of first indicia extends substantially the entire length of said first taxiway.

4. The method of claim 1, wherein said row of second indicia is positioned within 20 feet of the centerline of said first taxiway.

5. The method of claim 4, wherein said row of second indicia begins on said first taxiway at least 500 feet in advance of said intersection.

6. The method of claim 5, wherein said row of second indicia begins on said first taxiway at least 1,000 feet in advance of said intersection.

7. The method of claim 1, wherein said row of second indicia extends substantially the entire length of said runway or second taxiway.

8. A method for identifying airport taxiways and taxiway intersections, which method comprises the steps of:

marking a first taxiway with a continuous elongated row of first indicia identifying said first taxiway;

marking said first taxiway with a continuous elongated row of second indicia identifying an intersection with a runway or second taxiway beginning at least 100 feet in advance of said intersection, wherein the spacing between said second indicia increases with proximity to said intersection;

marking said intersection along the route to be traversed between said first taxiway and said runway or second taxiway with said row of second indicia; and marking said runway or second taxiway after said intersection with said row of second indicia, wherein said spacing between said second indicia decreases in proximity to said intersection and said second indicia extends substantially the entire length of said runway or second taxiway.

9. The method of claim 8, wherein said row of first indicia extends substantially along the centerline of said first taxiway.

10. The method of claim 8, wherein said row of first indicia extends substantially the entire length of said first runway.

11. The method of claim 8, wherein said row of second indicia is positioned within 20 feet of the centerline of said first taxiway.

12. The method of claim 8, wherein said row of second indicia begins on said first taxiway at least 500 feet in advance of said intersection.

13. The method of claim 12, wherein said row of second indicia begins on said first taxiway at least 1,000 feet in advance of said intersection.

14. The method of claim 8, wherein said row of second indicia extends substantially along the centerline of said runway or second taxiway.

* * * * *

UNITED STATES PATENT AND TRADEMARK OFFICE

CERTIFICATE OF CORRECTION

PATENT NO. : 5,288,163

DATED : February 22, 1994

INVENTOR(S) : Munson

It is certified that error appears in the above-identified patent and that said Letters Patent is hereby corrected as shown below:

On the title page, item [56]: second column, under "OTHER PUBLICATIONS", after "Controller Tells of Fright After Runway Near Crash," *"The New York Star-Ledger"* should read *--The Newark Star-Ledger--*.

Signed and Sealed this

Seventh Day of November, 1995

*Attest:*

*Attesting Officer*

BRUCE LEHMAN

*Commissioner of Patents and Trademarks*